US008058946B2

(12) United States Patent
Tiffin

(10) Patent No.: US 8,058,946 B2
(45) Date of Patent: Nov. 15, 2011

(54) CIRCUIT MODULE WITH NON-CONTACTING MICROWAVE INTERLAYER INTERCONNECT

(75) Inventor: Lawrence W. Tiffin, Vail, AZ (US)

(73) Assignee: Raytheon Company, Waltham, MA (US)

( * ) Notice: Subject to any disclaimer, the term of this patent is extended or adjusted under 35 U.S.C. 154(b) by 229 days.

(21) Appl. No.: 12/474,173

(22) Filed: May 28, 2009

(65) Prior Publication Data

US 2009/0295512 A1 Dec. 3, 2009

Related U.S. Application Data

(60) Provisional application No. 61/056,915, filed on May 29, 2008.

(51) Int. Cl.
*H01P 5/18* (2006.01)
*H01P 3/08* (2006.01)

(52) U.S. Cl. ..... 333/116; 333/238

(58) Field of Classification Search ..... 333/109, 333/110, 111, 112, 116, 24 R, 238
See application file for complete search history.

(56) References Cited

U.S. PATENT DOCUMENTS 3,999,150 A 12/1976 Caragliano
4,821,007 A * 4/1989 Fields et al. ..... 333/238
6,611,181 B2 8/2003 Marketkar
7,034,633 B2 * 4/2006 Passiopoulos et al. ..... 333/116
7,088,201 B2 8/2006 Piernas

OTHER PUBLICATIONS

Rogers Corporation, Design Equations for Broadside and Edgewise Stripline Couplers, Design 3.2.1, (c) 1982-2003 Rogers Corporation, Chandler, AZ, U.S.A.

David Lacombe and Jerome Cohen, Octave-Band Microstrip DC Blocks, IEEE Transactions on Microwave Theory and Techniques, Aug. 1972, p. 555.

* cited by examiner

*Primary Examiner* — Dean Takaoka
(74) *Attorney, Agent, or Firm* — SoCal IP Law Group LLP; John E. Gunther; Steven C. Sereboff

(57) ABSTRACT

A circuit module may include a first substrate having a first side and a second side, a second substrate having a third side and a fourth side, the third side facing the second side, and a resilient bond layer coupling the second side to the third side. The first substrate may have a first coefficient of thermal expansion and the second substrate may have a second coefficient of thermal expansion substantially different from the first coefficient of thermal expansion. A broadside coupler may couple a microwave signal from the first substrate to the second substrate. The broadside coupler may include a first conductive element formed on the second side and a second conductive element formed on the third side proximate the first conductive element.

17 Claims, 5 Drawing Sheets

CIRCUIT MODULE WITH NON-CONTACTING MICROWAVE INTERLAYER INTERCONNECT

RELATED APPLICATION INFORMATION

This application claims benefit under 35 U.S.C. §119(e) of the filing date of provisional patent application Ser. No. 61/056,915, filed May 29, 2008, entitled APPARATUS AND METHODS FOR COMPACT NON-CONTACTING MICROWAVE INTERCONNECT.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to microwave circuit modules.

2. Description of the Related Art

A circuit module is an assembly of components that are packaged or mounted together and constitute a functional unit for an electronic system. Examples of circuit modules include printed wiring assemblies and hybrid circuit assemblies. Circuit modules commonly include one or more substrates used to connect and support electronic components. Each substrate typically consists of conductive pathways laminated to one or more non-conductive layers. Substrates may be multi-layered, including multiple layers of substrate materials with conductive pathways on and between the substrate layers. Components and conductive pathways on different substrate layers may be connected by interlayer interconnects such as plated-through holes.

The substrate materials may be selected based on electrical properties such as dielectric constant, loss tangent, and dielectric strength; mechanical properties such as stiffness and thermal conductivity; cost; and other properties. Ideally, the various layers of a multilayer substrate could be selected independently based on desired characteristics for each layer. For example, in microwave circuit modules, a substrate layers supporting stripline components such as couplers and splitters would ideally be a material with low loss and well-controlled dielectric constant, while other substrate layers would ideally be selected for other characteristics such as lowest cost.

However, in many applications, multilayer substrates may be subjected to a wide range of ambient temperatures. In such applications, differences in the coefficient of thermal expansion (CTE) of the substrate layers may cause undesired effects such as deformation of the PWB and/or degradation of interlayer interconnects. Thus designers are generally forced to design circuit modules using a limited number of CTE-matched materials for the substrate layers.

Many of the materials used for substrate layers are composites containing reinforcing fibers such as glass fibers. For such composite materials, the CTE along the axis normal to the surfaces of the substrate may be different from the CTE along axes parallel to the surfaces of the substrate.

Throughout this description, elements appearing in figures are assigned three-digit reference designators, where the most significant digit is the figure number and the two least significant digits are specific to the element. An element that is not described in conjunction with a figure may be presumed to have the same characteristics and function as a previously-described element having a reference designator with the same least significant digits.

DETAILED DESCRIPTION

Description of Apparatus

Figure 1:
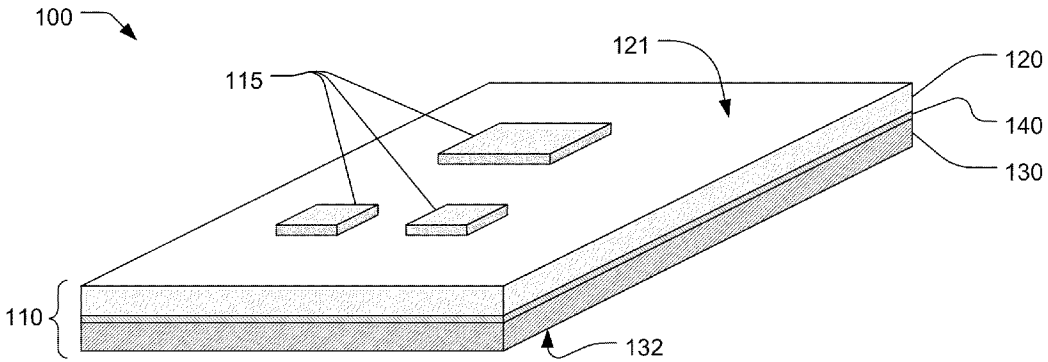
FIG. 1 is a perspective view of an exemplary circuit module.

Referring now to FIG. 1, a circuit module 100 may include a board 110 which supports and interconnects a plurality of electronic components 115. In this patent, the term "board" includes, but is not limited to, conventional PWBs. For example, the board 110 may be a PWB, a multilayer ceramic board, or an assembly of two or more substrates such as a semiconductor substrate and another substrate which may be a PWB.

For ease of description, the board 110 may include only a first substrate 120 and a second substrate 130 separated by a dielectric spacer 140. The first substrate 120 and the second substrate 130 may be planar and parallel. Either or both of the first substrate 120 and the second substrate 130 may be a laminate composed of two or more layers.

Electronic components 115 may be supported by a first side 121 of the first substrate 120. The electronic components 115 may be mounted on the first side 121, as shown in FIG. 1, or may be formed on or integrated into the first side 121. Although not visible in FIG. 1, electronic components may also be supported by a second side 132 of the second substrate 130. One or both sides of the first substrate 120 and the second substrate 130 may support conductive pathways which are not shown in FIG. 1.

Figure 2:
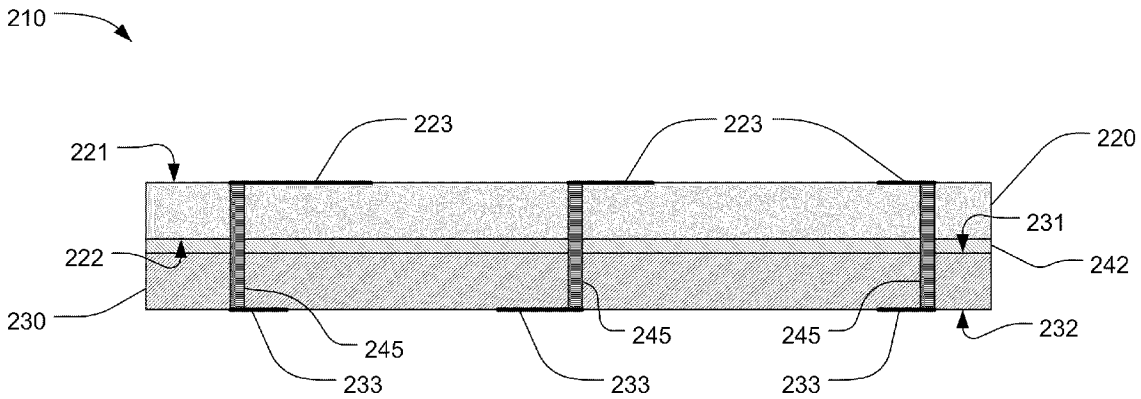
FIG. 2 is a cross-sectional view of a circuit module.

FIG. 2 shows a cross-section view of a board 210 which may be the board 110 of FIG. 1. The board 210 may include a first substrate 220 and a second substrate 230 separated and attached by a dielectric bond layer 242. The first substrate 220 may have a first side 221 and a second side 222. The second substrate may have a first side 231 and a second side 232. One or more of the sides 221, 222, 231, 232 may support conductive pathways 223, 233.

Conductive pathways 223 on the first substrate 220 may be electrically connected to conductive pathways 233 on the second substrate 230 by way of interlayer interconnects 245. Conventional interlayer interconnects 245 may be formed by drilling holes through the board 110 and then coating the inner surfaces of the drilled holes with an electrically conductive material. The inner surfaces of the drilled holes may be coated, for example, by electroless plating and/or electroplating a conductive metal material such as copper. Such interlayer interconnects are commonly called "plated through holes". The diameter of the drilled holes may typically be from 0.005 inch to 0.020 inch. The thickness of the plated conductive material may typically be about 0.0015 inch.

The first substrate 220 may have a first CTE along an axis parallel to the first side 221 and the second side 222. The second substrate 230 may have a second CTE along an axis parallel to the third side 231 and the fourth side 232. In many applications, the first substrate 220 and the second substrate 230 may be the same material or two different materials having nearly the same CTE. However, in some applications, the first CTE and the second CTE may be substantially different. For example, the first substrate 220 may be a low-cost conventional epoxy-glass PWB material and the second substrate 230 may be a material having very low loss at microwave frequencies, such as a RT/DUROID material available from Rogers Corporation. In this example, the first CTE may be about 9 parts-per-million (ppm) per ° C., and the second CTE may be 15 to 50 ppm depending on the choice of the low-loss material.

The difference between the first CTE and the second CTE may have no effect on the reliability or performance of the board 210 if the board 210 is only exposed to a limited temperature range. However, many applications require a board to be exposed to a wide temperature range. For example, military equipment may be required to operate reliably after repeated cycling between temperatures as low as −55° C. and as high as +85° C. Commercial equipment may be exposed to temperatures between −40° C. and +70° C. during shipment. The specifications for a board may commonly include a maximum temperature and a minimum temperature to which the board may be exposed without degradation. The specification may also define test procedures, such as a temperature cycling test, intended to demonstrate the reliability of the board.

Changes in the temperature of the board 210 may cause the first substrate 220 and the second substrate 230 to expand or contract by different amounts in accordance with the respective first CTE and second CTE. If the first substrate 220 and the second substrate 230 are rigidly attached by the bond layer 242, the difference in expansion or contraction of the first and second substrates 220, 230 may cause the board 210 to bend, curl, or crack. Since curling of the board 210 would be unacceptable in most applications, the bond layer 242 may be a resilient material to accommodate the relative motion of the first and second substrates 220, 230 due to the difference in expansion or contraction. However the relative motion of the first and second substrates 220, 230 with temperature may still degrade the plated-though interlayer interconnects 245. Simplistically, the relative motion of the first and second substrates 220, 230 with temperature may tend to bend and/or stretch the plated-though interlayer interconnects 245 as they pass through the resilient bond layer 242. The bending and/or stretching of the interlayer interconnects 245 may cause degradation in the form of decreased conductivity or complete failure (loss of electrical continuity) of at least some of the interlayer interconnects 245.

In this patent, the CTE values for two substrate layers will be considered as "substantially different" if a board fabricated using the two substrate layers will incur degraded electrical performance or degraded reliability when the board is exposed to a specified temperature range or subjected to a specified test procedure. The determination if two CTE values are substantially different depends on both the materials used for the two substrate layers and the environment in which the board will be used.

The problem of degraded plated-through interlayer interconnects may be ameliorated, at least in part, by using redundant interlayer interconnects. For example, DC levels such as power forms and low-speed signals may be coupled between the first substrate 220 and the second substrate 230 using multiple parallel interlayer interconnects such that degradation of a portion of the redundant interlayer interconnects may not materially effect the performance or reliability of the board 210. The problem of degraded plate-through interlayer interconnects may be avoided completely by using flexible interlayer interconnects such as jumper wires or flexible flat cables. However, redundant interlayer interconnects and/or flexible interlayer interconnects may not be convenient or practical for microwave signals.

Figure 3A:
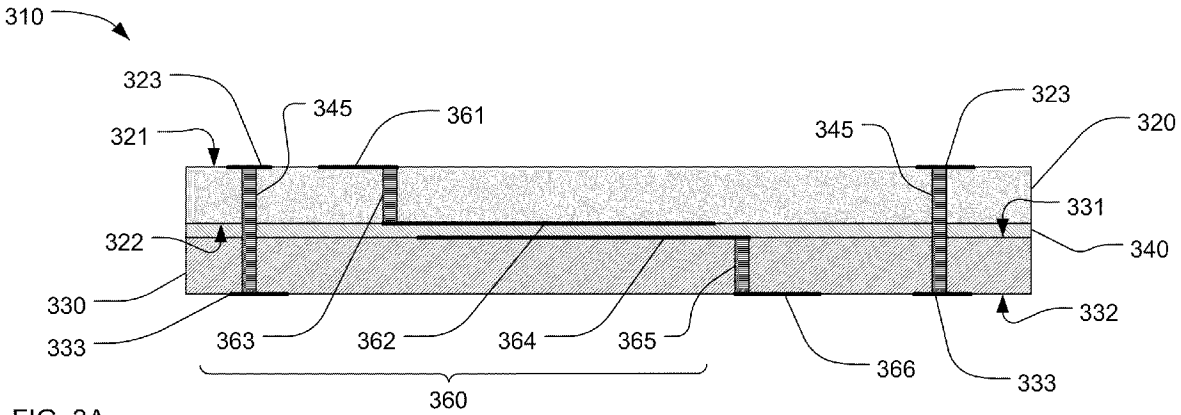
FIG. 3A is a cross-sectional view of a board including a non-contacting microwave interlayer interconnect.

FIG. 3A shows a cross-section view of a board 310 which may be the board 110 of FIG. 1. The board 310 may include a first substrate 320 and a second substrate 330. The first substrate 320 may have a first CTE and the second substrate 330 may have a second CTE substantially different from the first CTE (as previously defined). The first substrate 320 may have a first side 321 and a second side 322. The second substrate may have a third side 331 and a fourth side 332. The second side 322 and the third side 331 may be parallel and separated by a dielectric spacer 340. One or more of the sides 321, 322, 331, 332 may support conductive pathways 323, 333.

The dielectric spacer 340 may attach the first substrate 320 and the second substrate 330. In this case, the dielectric spacer 340 may be a layer of resilient dielectric material adhered or bonded to both the first substrate 320 and the second substrate 330. The dielectric spacer 340 may not attach the first substrate 320 and the second substrate 330. For example, the dielectric spacer 340 may be adhered to only the first substrate 320, such that the second substrate 330 may be free to move, to at least some extent, parallel to the plane of the first substrate 320. In this case, the second substrate 330 may be held in contact with the dielectric spacer 340 by fasteners that are not shown in FIG. 3.

Conductive pathways 323 carrying DC or low frequency signals on the first substrate 320 may be electrically connected to conductive pathways 333 on the second substrate 330 by way of redundant interlayer interconnects 345 or flexible interlayer interconnects (not shown). A microwave signal may be coupled from a conductive pathway 361 on the first side 321 to a conductive pathway 366 on the fourth side 332 by a broadside coupler 360.

Figure 3B:
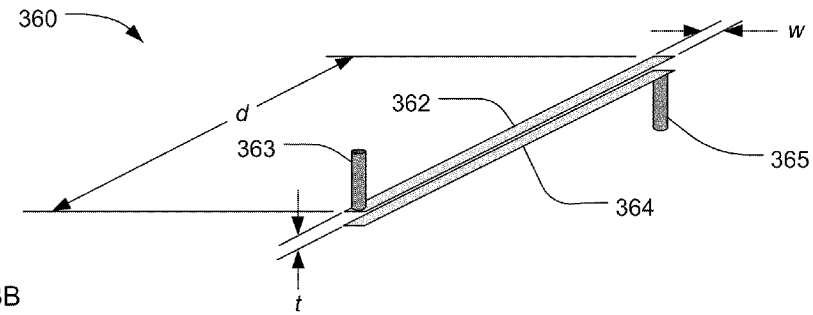
FIG. 3B is a perspective view of the non-contacting microwave interlayer interconnect of FIG. 3A.

The broadside coupler 360 is shown in perspective view in FIG. 3B. To allow a clear view of the elements of the broadside coupler 360, the first substrate 320, the second substrate 330, and the dielectric spacer 340 are not shown in FIG. 3B.

The broadside coupler 360 may include a first conductive element 362 formed on the second side 322 and a second conductive element 364 formed on the third side 331 proximate to the first conductive element 362. The first conductive element 362 and the second conductive element 364 may be in a facing relationship separated by the dielectric spacer 340. The first conductive element 362 and the second conductive element 364 may be straight and parallel as shown in FIG. 3B. The second conductive element 364 may be rotated with respect to the first conductive element 362. The first conductive element 362 may be electrically connected to the conductive pattern 361 on the first side 321 by a first via 363. The second conductive element 364 may be electrically connected to the conductive pattern 366 on the fourth side 332 by a second via 365. For example, the first and second vias 363, 365 may be plated-though holes that only penetrate the respective first and second substrates 320, 330.

The broadside coupler 360 functions as a non-contacting interlayer interconnect for the microwave signal. Since there is no direct electrical contact between the first conductive element 362 and the second conductive element 364 through the bond layer 340, the electrical characteristics of the broadside coupler may not degrade when the board 310 is subjected to extreme temperatures or temperature cycles.

In some circumstances, it may be beneficial to assemble the board 310 without bonding the first substrate 320 to the second substrate 330 even in the absence of a substantial difference in the CTEs of the first substrate 320 and the second substrate 330. For example, assembling the board 310 without bonding the first substrate 320 to the second substrate 330 may facilitate independent testing of portions of the board 310. For further example, assembling the board 310 without bonding the first substrate 320 to the second substrate 330 may allow a portion of a circuit module to be replaced or repaired in the event of a component failure without requiring removal of the entire circuit module.

A length d and a width w of the first and second conductive elements 362, 364 and a spacing t between the first and second conductive elements 362, 364 may be selected to provide high coupling efficiency for a microwave signal of a predetermined frequency or with a predetermined frequency band. For example, the length d of the first conductive element 362 and the second conductive element 364 may be one-quarter of the wavelength of a signal having the predetermined frequency or falling within the predetermined frequency band.

The length d, the width w and the spacing t may be selected such that the broadside coupler satisfies the equation $$Z_0 = \frac{Z_{0E} - Z_{0O}}{2} \tag{1}$$

wherein:

$Z_0$ is a characteristic impedance of the broadside coupler, $Z_{0E}$ is an even-mode impedance of the broadside coupler, and $Z_{0O}$ is an odd-mode impedance of the broadside coupler.

When the length d, the width w and the spacing t are selected to satisfy equation (1), the broadside coupler 360 may efficiently couple a microwave signal with low insertion loss over a frequency range in excess of one octave, as described in Lacombe and Cohen, *Octave-Band Microstrip DC Blocks*, IEEE transactions on Microwave Theory and Techniques, August 1972, pp. 555-6. $Z_0$, $Z_{0E}$, and $Z_{0O}$ may be determined by analysis using known equations for the impedances of broadside couplers, as described in Cohn, *Characteristic Impedances for Broadside Couple Strip Transmission Lines*, IRE Transactions on Microwave Theory and Techniques, November 1960, pp. 633-637. $Z_0$, $Z_{0E}$, and $Z_{0O}$ may be determined by simulation.

Figure 4C:
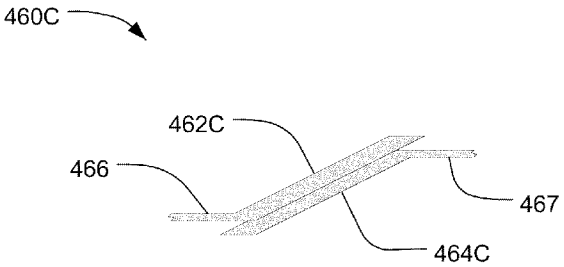
FIG. 4C is a perspective view of a non-contacting microwave interlayer interconnect.
Figure 4A:
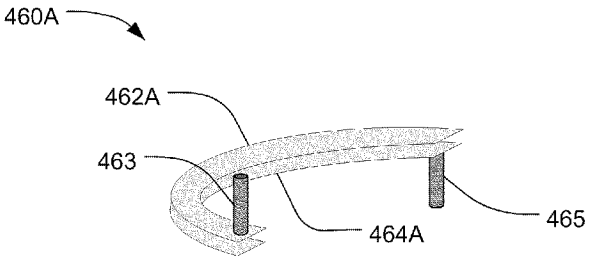
FIG. 4A is a perspective view of a non-contacting microwave interlayer interconnect.
Figure 4B:
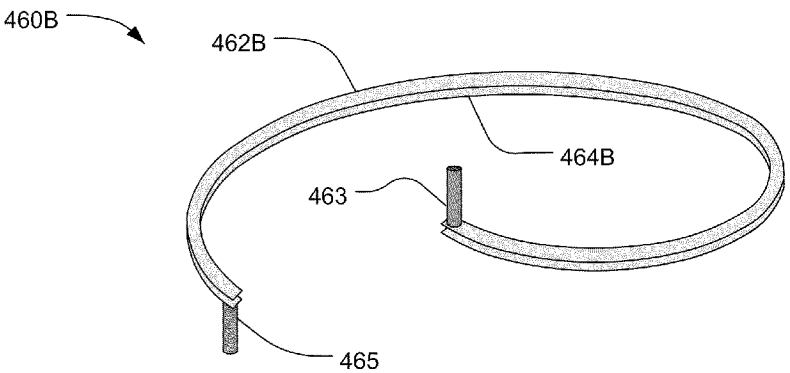
FIG. 4B is a perspective view of a non-contacting microwave interlayer interconnect.

FIGS. 4A, 4B, and 4C show perspective views of other exemplary broadside couplers that may be suitable for use as non-contacting microwave interlayer interconnects. FIG. 4A shows another broadside coupler 460A including a first conductive element 462A and a second conductive element 464A which are curved in a generally semicircular shape. Curving the first conductive element 462A and the second conductive element 464A may reduce the overall length of the broadside coupler 462A compared to a coupler, such as the coupler 360, based on straight conductive elements. The first conductive element 462A and a second conductive element 464A may be curved in other shapes such as an "S" curve that are not shown in FIG. 4A.

FIG. 4B shows another broadside coupler 460B including a first conductive element 462B and a second conductive element 464B which are curved into a single-turn spiral to further reduce the overall length of the coupler 460B. The first conductive element 462A and the second conductive element 464B may be curved even further into respective multiple-turn spirals that not shown in FIG. 4B.

The conductive elements forming a non-contacting microwave interlayer interconnect may not connect directly to vias 363, 365, 463, 465 as shown in FIGS. 3, 4A, and 4B. FIG. 4C is a perspective view of another broadside coupler 460C including a first conductive element 462C and a second conductive element 464C which may be straight, as shown, or curved as shown in FIG. 4A and FIG. 4B. The first conductive element 462C and the second conductive element 464C may connect to electronic components or other portions of circuit module through microstrip transmission lines 466, 467, respectively, or other conductive patterns.

Description of Processes

Figure 5:
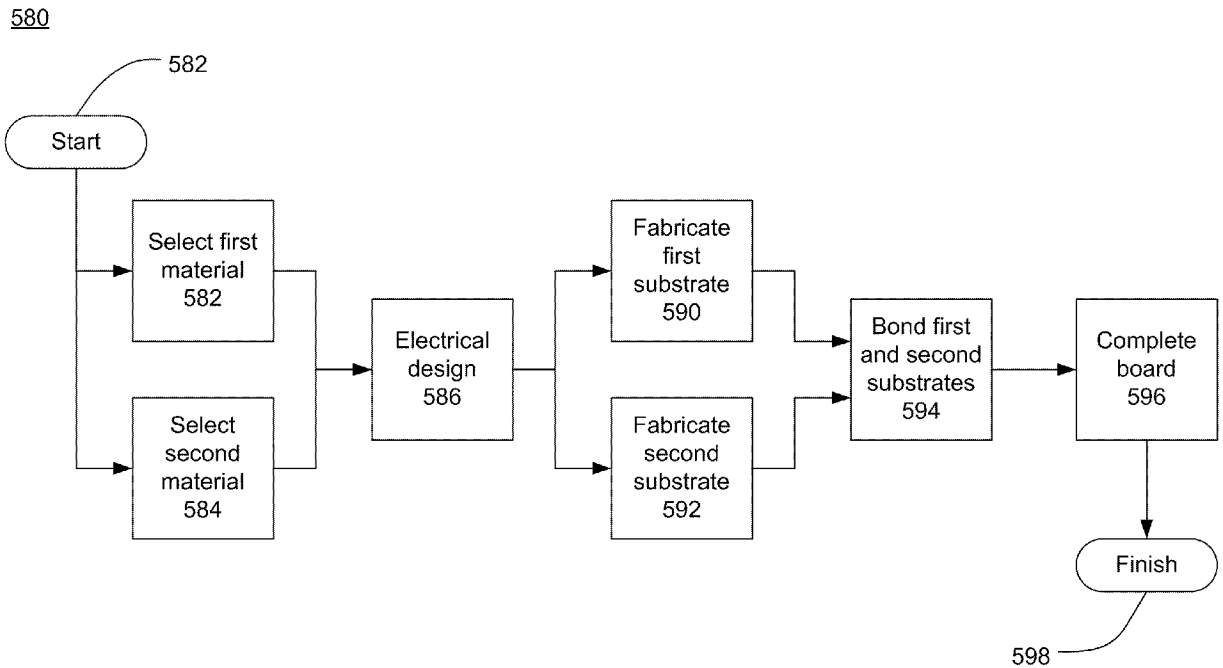
FIG. 5 is a flow chart of a process for manufacturing a circuit module.

Referring now to FIG. 5, a method for providing a board, such as the board 310, may begin at 582 with a specification for the completed board and may end a 598 with the completion of at least one board meeting the specification.

At 582, a first material for use in at least one layer of the board may be selected based on first criteria. For example, the first material may be intended as the substrate for precision microwave splitter and/or phase shifting circuits. In this case, the first criteria may include very low loss tangent and/or well-controlled dielectric constant at a specific microwave frequency of range of frequencies.

At 584, a second material may be selected for use in at least one other layer of the board may be selected based on second criteria. For example, the second criteria may include high thermal conductivity for removing heat from electronic components, or a specific value of dielectric constant different from the dielectric constant of the first material, or simply the lowest possible cost. The second criteria may not include matching a CTE of the second material to a CTE for the first material, with the result that the CTEs of the first and second materials may differ substantially.

At 586, an electrical design of the board may be completed based on the specification from 582 and the properties of the first and second material selected at 582 and 584, respectively. The electrical design may include arranging electronic components to be mounted on the board and routing conductive pathways and conductive elements on two or more substrate layers. The electrical design at 586 and the material selection at 582 and 584 may be performed, at least partially, in parallel. The electrical design at 586 and the material selection at 582 and 584 may be iterative, which is to say that the electrical design at 586 may result in changes to the material selections from 582 and 584. The output from the electrical design at 586 ay be drawings, photo masks, drill tapes, and other data needed for the subsequent fabrication of the board The electric design at 586 may include selecting dimensions for a first conductive member and a second conductive member that, when the board is assembled, will function as non-contacting interlayer interconnect to couple a microwave signal from the first substrate to the second substrate. The dimensions of the first conductive member and a second conductive member and the thickness and other characteristics of the bond layer may be selected such that equation (1) is satisfied.

At 590, at least one copy of the first substrate may be fabricated from the first material. The first substrate may have a first side and a second side which may support conductive pathways including the first conductive element formed on the second side. The first substrate may include one or more vias connecting conductive patterns on the first side to conductive patterns on the second side.

At 592, at least one copy of the second substrate may be fabricated from the second material. The second substrate may have a third side and a fourth side which support conductive pathways including the second conductive element formed on the third side. The second substrate may include one or more vias connecting conductive patterns on the third side to conductive patterns on the forth side.

At 594, the first substrate and the second substrate may be assembled such that the second side of the first substrate and the third side of the second substrate are parallel and separated by a dielectric spacer. For example, the second substrate may be attached to the first substrate by bonding the third side to the second side with a resilient dielectric layer. For further example, the first substrate and the second substrate may be assembled using fasteners or some other mechanism that allows the second substrate to move, to at least some extent, in a plane parallel to the first substrate. After the first substrate and the second substrate are attached, the second conductive member may be disposed proximate to the first conductive member to form the non-contacting microwave interlayer interconnect.

The board may be completed at 596. Completing the board may include drilling and plating through holes to establish interlayer electrical connections from the first substrate to the second substrate. Completing the board may include other actions such as applying markings and/or applying a solder mask to one or both sides of the board.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

What is claimed is:

1. A circuit module, comprising:

a first substrate having a first side and a second side, the first substrate fabricated from a first material having a coefficient of thermal expansion in a direction parallel to the first side of less than or equal to 10 parts-per-million per C.°;

a second substrate having a third side and a fourth side, the third side separated from the second side by a dielectric spacer, the second substrate fabricated from a second material having a coefficient of thermal expansion in a direction parallel to the third side from 15 parts-per-million per C.° to 50 parts-per-million per C.°;

a broadside coupler adapted to couple a microwave signal from the first substrate to the second substrate, the broadside coupler comprising:

a first conductive element formed on the second side a second conductive element formed on the third side proximate the first conductive element.

2. The circuit module of claim 1, wherein the broadside coupler satisfies the equation $$Z_0 = \frac{Z_{0E} - Z_{0O}}{2}$$

wherein:

$Z_0$ is a characteristic impedance of the broadside coupler, $Z_{0E}$ is an even-mode impedance of the broadside coupler, and $Z_{0O}$ is an odd-mode impedance of the broadside coupler.

3. The circuit module of claim 1, wherein the first material is selected from the group consisting of epoxy-glass and polyimide-glass.

4. The circuit module of claim 1, wherein the second material has a dissipation factor less than or equal to 0.003 at a frequency of 10 GHz.

5. The circuit module of claim 1, wherein the dielectric spacer layer is a resilient material adhered to both the first substrate and the second substrate.

6. The circuit module of claim 5, wherein the first substrate, the second substrate, and the dielectric spacer layer are incorporated in a printed wiring board.

7. The circuit module of claim 1, wherein the dielectric spacer layer is adhered to the first substrate, and the second substrate is free to move, to at least some extent, in a plane parallel to the first substrate.

8. The circuit module of claim 1, wherein the first substrate is a semiconductor device.

9. A method for providing a board, comprising:

fabricating a first substrate from a first material, the first substrate having a first side and a second side and a first conductive element formed on the second side, the first material selected based on a first criteria, the first material having a coefficient of thermal expansion in a direction parallel to the first side of less than or equal to 10 parts-per-million per C.°;

fabricating a second substrate from a second material, the second substrate having a third side and a fourth side and a second conductive element formed on the third side, the second material selected based on a second criteria, the second material having a coefficient of thermal expansion in a direction parallel to the first side from 15 parts-per-million per C.° to 50 parts-per-million per C.°; and assembling the first substrate and the second substrate with the third side separated from the second side by a dielectric spacer, wherein the second conductive member is disposed proximate to the first conductive member to form a broadside coupler configured to couple a microwave signal from the first substrate to the second substrate.

10. The method of claim 9, further comprising selecting dimensions for the first conductive element and the second conductive element such that the broadside coupler satisfies the equation $$Z_0 = \frac{Z_{0E} - Z_{0O}}{2}$$

wherein:

$Z_0$ is a characteristic impedance of the broadside coupler, $Z_{0E}$ is an even-mode impedance of the broadside coupler, and $Z_{0O}$ is an odd-mode impedance of the broadside coupler.

11. The method of claim 9, wherein the first material is selected from the group consisting of epoxy-glass and polyimide-glass.

12. The method of claim 9, wherein the second material has a dissipation factor less than or equal to 0.003 at a frequency of 10 GHz.

13. The method or claim 9, wherein assembling the first substrate and the second substrate further comprises:

bonding the first substrate to the second substrate with a dielectric adhesive spacer to form a printed wiring board.

14. A circuit module, comprising:

a first substrate having a first side and a second side, the first substrate fabricated from a first material having a coefficient of thermal expansion in a direction parallel to the first side of less than or equal to 10 parts-per-million per C.°;

a second substrate having a third side and a fourth side, the third side separated from the second side by a dielectric spacer, the second substrate fabricated from a second material having a coefficient of thermal expansion in a direction parallel to the third side from 15 parts-per-million per C.° to 50 parts-per-million per C.°;

a broadside coupler adapted to couple a microwave signal from the first substrate to the second substrate, the broadside coupler comprising:

a first conductive element formed on the second side, and a second conductive element formed on the third side proximate the first conductive element, wherein at least one of the first substrate and the second substrate is not adhered to the dielectric spacer such that the second substrate is free to move relative to the first substrate, to at least some extent, in a plane parallel to the first substrate.

15. The circuit module of claim 14, wherein the broadside coupler satisfies the equation $$Z_0 = \frac{Z_{0E} - Z_{0O}}{2}$$

wherein:

$Z_0$ is a characteristic impedance of the broadside coupler, $Z_{0E}$ is an even-mode impedance of the broadside coupler, and $Z_{0O}$ is an odd-mode impedance of the broadside coupler.

16. The circuit module of claim 14, wherein the first material is selected from the group consisting of epoxy-glass and polyimide-glass, and the second material has a dissipation factor less than or equal to 0.003 at a frequency of 10 GHz.

17. The circuit module of claim 14, wherein the first substrate is a semiconductor device.

* * * * *